US007513853B1

(12) United States Patent
Russ

(10) Patent No.: US 7,513,853 B1
(45) Date of Patent: Apr. 7, 2009

(54) EXERCISE APPARATUS

(76) Inventor: Dennis J. Russ, 8090 N. US Highway 31, Free Soil, MI (US) 49411

( * ) Notice: Subject to any disclaimer, the term of this patent is extended or adjusted under 35 U.S.C. 154(b) by 55 days.

(21) Appl. No.: 11/428,701

(22) Filed: Jul. 5, 2006

Related U.S. Application Data

(60) Provisional application No. 60/697,023, filed on Jul. 6, 2005.

(51) Int. Cl.
*A63B 22/00* (2006.01)

(52) U.S. Cl. ..... 482/51; 482/52; 482/53; 482/62; 482/28; 482/96

(58) Field of Classification Search ..... 482/86, 482/51, 52, 57, 71, 74, 79, 83, 87, 120, 53
See application file for complete search history.

(56) References Cited

U.S. PATENT DOCUMENTS

| | | | | | |
|---|---|---|---|---|---|
| 1,928,089 | A * | 9/1933 | Blickman | ..... | 482/90 |
| 4,569,401 | A * | 2/1986 | Luck | ..... | 482/57 |
| 5,058,882 | A * | 10/1991 | Dalebout et al. | ..... | 482/53 |
| 5,060,935 | A * | 10/1991 | Dunn et al. | ..... | 482/53 |
| 5,062,627 | A * | 11/1991 | Bingham | ..... | 482/53 |
| 5,078,390 | A * | 1/1992 | Hurt | ..... | 482/53 |
| 5,129,872 | A * | 7/1992 | Dalton et al. | ..... | 482/52 |
| 5,178,591 | A * | 1/1993 | Lyons | ..... | 482/52 |
| 5,190,505 | A * | 3/1993 | Dalebout et al. | ..... | 482/52 |
| 5,299,995 | A * | 4/1994 | Ko | ..... | 482/52 |
| 5,304,106 | A * | 4/1994 | Gresko | ..... | 482/53 |
| 5,316,527 | A * | 5/1994 | Lekhtman | ..... | 482/41 |
| 5,336,146 | A * | 8/1994 | Piaget et al. | ..... | 482/54 |
| 5,411,454 | A * | 5/1995 | Chang | ..... | 482/53 |
| 5,582,561 | A * | 12/1996 | Gonzalez | ..... | 482/83 |
| 5,607,377 | A * | 3/1997 | Wilkinson | ..... | 482/83 |
| 5,749,809 | A * | 5/1998 | Lin | ..... | 482/52 |
| 6,019,710 | A * | 2/2000 | Dalebout et al. | ..... | 482/70 |
| 6,106,439 | A * | 8/2000 | Boland | ..... | 482/51 |
| 6,152,863 | A * | 11/2000 | Nelson et al. | ..... | 482/83 |
| 6,220,992 | B1 * | 4/2001 | Shafik | ..... | 482/83 |
| 6,585,274 | B2 * | 7/2003 | Sawyer | ..... | 280/37 |
| 6,976,945 | B1 * | 12/2005 | Lim | ..... | 482/148 |
| 7,097,593 | B2 * | 8/2006 | Chang | ..... | 482/54 |
| 7,217,225 | B2 * | 5/2007 | Husted et al. | ..... | 482/51 |
| 2002/0160889 | A1 * | 10/2002 | Lederman | ..... | 482/83 |
| 2004/0092368 | A1 * | 5/2004 | Gramaccioni | ..... | 482/70 |
| 2004/0157707 | A1 * | 8/2004 | Yang | ..... | 482/53 |
| 2005/0070403 | A1 * | 3/2005 | Yu | ..... | 482/53 |
| 2005/0164849 | A1 * | 7/2005 | Saikawa | ..... | 482/92 |

* cited by examiner

*Primary Examiner*—Fenn C Mathew
*Assistant Examiner*—Robert F Long
(74) *Attorney, Agent, or Firm*—McGarry Bair PC

(57) ABSTRACT

An exercise apparatus for exercising a user's body comprises an upper exercise assembly, a lower exercise assembly, and a pair of step assemblies. The upper exercise assembly enables exercising of the user's upper body through alternating extension and retraction of the user's arms. The upper exercise assembly comprises an upright member coupled with an overhead member having an impact member suspended therefrom. The lower exercise assembly comprises an upright member coupled with a base member. The upright member of the lower exercise assembly can be coupled with the upright member of the upper exercise assembly. The pair of step assemblies is pivotally coupled with the lower exercise assembly for exercising the user's lower body through an alternating stepping motion. The user can repeatedly strike the impact member while performing the alternating stepping motion to simultaneously exercise the user's upper and lower body.

9 Claims, 4 Drawing Sheets

EXERCISE APPARATUS

CROSS-REFERENCE TO RELATED APPLICATION

This application claims the benefit of U.S. provisional application Ser. No. 60/697,023, filed Jul. 6, 2005, which is incorporated herein in its entirety.

FIELD OF THE INVENTION

The invention relates to exercise machines and in particular to an exercise machine for simultaneously exercising the upper body and the lower body.

DESCRIPTION OF THE RELATED ART

Exercise machines are widely used to improve strength and cardio-vascular fitness, enhance balance, moderate the effects of aging, and generally promote health. Frequently, exercise machines are used for a single purpose, such as strengthening biceps or abdominal muscles, or for a limited number of inter-related purposes, such as improving heart and lung performance, or strengthening the upper body.

In order to exercise the entire body, it is necessary to use a variety of exercise machines or stations, or a large multi-station machine. While this may be feasible in a gymnasium or health club, it is impractical for most home installations because of usage space and storage limitations. Thus, an individual desiring a home-based exercise machine must limit his or her choices to a selected few devices focused on exercising only selected muscles, or must supplement home exercising with an out-of-home program at a health club or other facility.

SUMMARY OF THE INVENTION

An exercise apparatus for exercising a user's body comprises an upper exercise assembly, a lower exercise assembly, and a pair of step assemblies. The upper exercise assembly enables exercising of the user's upper body through alternating extension and retraction of the user's arms. The upper exercise assembly comprises an upright member coupled with an overhead member having an impact member suspended therefrom. The lower exercise assembly comprises an upright member coupled with a base member. The upright member of the lower exercise assembly can be coupled with the upright member of the upper exercise assembly. The pair of step assemblies is pivotally coupled with the lower exercise assembly for exercising the user's lower body through an alternating stepping motion. The user can repeatedly strike the impact member while performing the alternating stepping motion to simultaneously exercise the user's upper and lower body.

DESCRIPTION OF AN EMBODIMENT OF THE INVENTION

Figure 2:
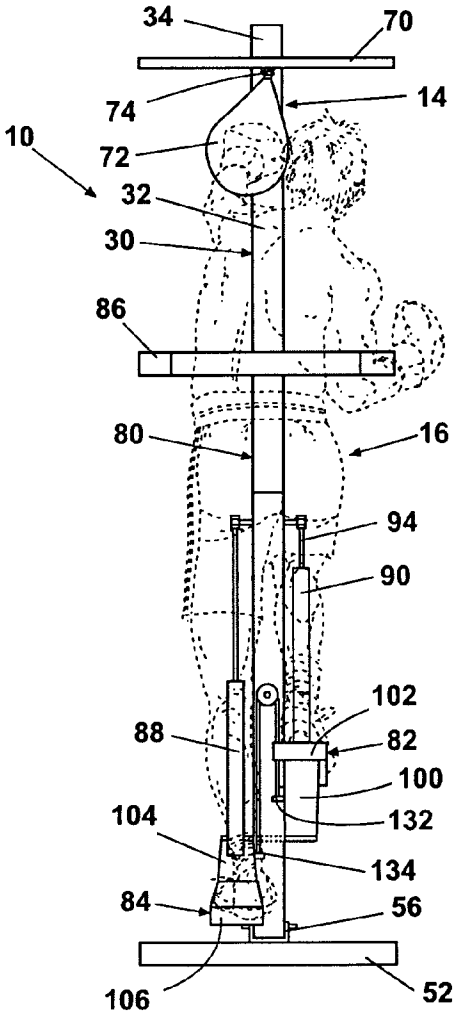
FIG. 2 is a first rear elevational view of the exercise apparatus illustrated in FIG. 1.

Referring now to FIGS. 1-4, a first embodiment of an exercise apparatus 10 according to the invention is illustrated comprising a frame assembly 12 having an upper exercise assembly 14 and a lower exercise assembly 16. The frame assembly 12 is fabricated of a material, preferably a metal such as steel or aluminum, having sufficient strength and rigidity for the purposes described herein. The frame assembly 12 can be fabricated of members comprising an I-beam cross-section, a tubular configuration, solid bars, and the like. The embodiment described hereinafter will be described with respect to a frame assembly 12 fabricated of tubular members The upper exercise assembly 14 comprises an upper frame 30 having an upright member 32 and an overhead member 34. The upright member 32 is rigidly attached to the overhead member 34, preferably orthogonally thereto. Spaced somewhat away from a lower end of the upright member 32 is an aperture extending therethrough.

The lower exercise assembly 16 comprises a lower frame 36 having an upright member 38 and a base member 40. The upright member 38 is preferably attached to the base member 40 by a pivot connection 54 to enable the base member 40 to be rotated upwardly from a position generally orthogonal to the upright member 38 to a position generally parallel to the upright member 38. Alternatively, the upright member 38 can be rigidly attached to the base member 40. Extending upwardly from an end of the upright member 38 is an insert portion 44 having cross-sectional dimensions somewhat smaller than the dimensions of the upright member 38 and adapted for slidable insertion into the upper frame upright member 32. A plurality of regularly-spaced apertures 46 extend through the insert portion 44. It will be obvious to a person having an ordinary level of skill in the relevant art that other means of adjustably joining the upright member 38 and the upright member 32 can be utilized.

The upright member 38 has an opening 58 extending therethrough at an upper portion of the upright member 38 for slidable receipt of a brace 42 parallel to the base member 40. The upright member 38 has an aperture extending therethrough to intersect the opening 58. The brace 42 is provided with a plurality of regularly-spaced apertures 60 which, when aligned with the aperture in the upright member 38, can receive a fastener 48, such as a threaded bolt or a quick-release pin, extending therethrough to fix the brace 42 in a selected orientation relative to the upright member 38. Other means of adjusting the orientation of the brace 42 relative to the upright member 38 known to a person having an ordinary level of skill in the relevant art can be employed, such as a brace having telescoping sections.

The base member 40 is an elongated, beam-like member comprising a front foot 50 and a rear foot 52 extending laterally therefrom and fixedly attached to the ends of the base member 40 in order to provide lateral stability to the exercise apparatus 10. The base member 40 is provided with a clevis 56 extending upwardly therefrom. The clevis 56 can be fixedly attached to the base member 40 at a preselected location along the base member 40, or the clevis 56 can comprise a portion of an assembly slidable along the base member 40 to a selected position and fixed in place with a lock screw 64. FIG. 5C illustrates a clevis plate assembly 126 that is adapted for use with right and left step assemblies 82, 84 and resistance cylinders 88, 90, as hereinafter described, that can be similarly adapted to attach the clevis 56 to the base member 40. With such an attachment, the base member 40 will be adapted as generally described hereinafter with respect to the right and left step assemblies 82, 84. Other means of slidably attaching the clevis 56 to the base member 40 will be evident to a person of ordinary skill in the relevant art.

The lower exercise assembly 16 comprises a support post 80 supporting a left step assembly 82 and a right step assembly 84. The support post 80 terminates at an upper end in a hand rest 86 adapted for gripping by a user of the exercise apparatus 10, and at a lower end in an aperture for pivotable attachment of the support post 80 to the clevis 56. The support post 80 is also attached to the brace 42, preferably through a pivot connection. Alternatively, the brace 42 can be rigidly attached to the support post 80 to extend orthogonally thereto. The left step assembly 82 comprises a step rail 100 terminating at one end in a pedal 102. The right step assembly 84 comprises a step rail 104 terminating at one end in a pedal 106. The step rails 100, 104 are elongated, rigid structural members having a slot extending longitudinally along an upper surface thereof. As illustrated in FIG. 5C, the step rails 100, 104 can comprise a rectilinear tubular member comprising a pair of coplanar, parallel flanges 162, 164 in spaced-apart relationship to define a slot 166 therebetween. A lower wall of the step rails 100,104 comprises a bearing surface 160. The step rails 100, 104 are attached through a pivot connection 108 to a mounting member 120 fixedly attached orthogonally to the support post 80 at a lower portion thereof. A reinforcing gusset plate 122 can be used to strengthen the connection of the mounting member 120 to the support post 80. The step rails 100, 104 are provided with a clevis 124 rigidly attached to a clevis plate assembly 126 for pivotable attachment of resistance cylinders 88, 90 to the step rails 100, 104, respectively.

A resistance cylinder 88 is coupled to the left step assembly 82, and a resistance cylinder 90 is coupled to the right step assembly 84. The resistance cylinder 88, 90 comprises a piston rod 92, 94, respectively, and an internal piston to provide a dampening or resistance force to movement of the piston rod 92, 94 relative to the cylinder 88, 90. The piston rod 92, 94 is attached to the support post 80 through a pivot connection 96 to enable the resistance cylinder 88, 90 to pivot relative to the support post 80. The resistance cylinder 88, 90 can be adapted for selective adjustment of the resistance to movement of the piston rod 92, 94.

Figure 5A:
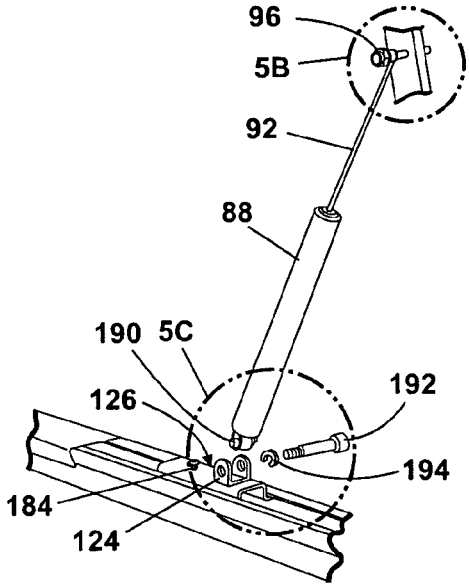
FIG. 5A is a partially exploded view of a resistance cylinder comprising a portion of the exercise apparatus mounted at an upper portion and a lower portion within the exercise apparatus.
Figure 5B:
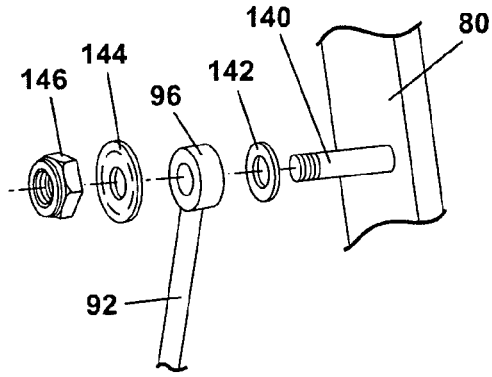
FIG. 5B is an enlarged exploded view of the mounting of the upper portion of the resistance cylinder within the exercise apparatus.
Figure 5C:
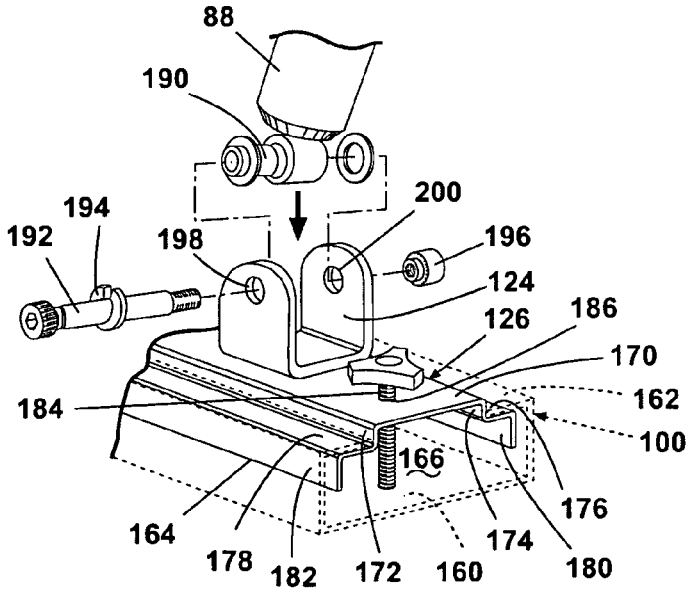
FIG. 5C is an enlarged exploded view of the mounting of the lower portion of the resistance cylinder within the exercise apparatus.

Referring now to FIGS. 5A and B, the pivot connection 96 preferably comprises a threaded post 140 extending orthogonally from the support post 80 adapted for slidable receipt of a washer 142, the piston rod 92, 94, and a washer 144, which are secured to the threaded post 140 by a lock nut 146.

Referring now to FIGS. 5A and C, the resistance cylinder 88, 90 terminates at a closed end in a sleeve adapted for receipt of a bushing 190 therethrough. A fastener 192, such as a threaded bolt, is adapted to extend through apertures 198, 200 in the clevis 124 and the bushing 190 to pivotally attach the resistance cylinder 88, 90 to the clevis 124. The fastener 192 is rotatably attached to the clevis with a lock washer 194 and a nut 196.

The clevis plate assembly 126 comprises a generally plate-like body having sufficient strength and rigidity for the purposes described herein, and adapted for fixed attachment to the clevis 124, such as by welding. As illustrated in FIG. 5C, the clevis plate assembly 126 comprises a top plate 170 to which the clevis 124 is attached. The top plate 170 is provided with a threaded aperture 186 extending therethrough for threadable receipt of a lock screw 184. The top plate 170 transitions laterally to a pair of parallel, depending side walls 172, 174 adapted for slidable registry with the slot 166. The side walls 172, 174 transition orthogonally to a pair of coplanar flanges 176, 178, which terminate in a pair of parallel, downwardly depending side walls 180, 182. The clevis plate assembly 126 can thus translate along the slot 166 and can be fixed in a preselected location along the step rail 100, 104 by threading the lock screw 184 against the bearing surface 160 to urge the flanges 176, 178 against the flanges 162, 164.

The support post 80 is also provided with a pulley 128 adapted to receive a cable 130 attached to the step rails 100, 104 through cable attachments 132, 134, such as eye bolts, for support of the step assemblies 82, 84. The cable 130 is looped over the pulley 128 and the step assemblies 82, 84 are suspended therefrom.

The upper exercise assembly 14 comprises a mounting plate 70 attached to an underside of the overhead member 34 and adapted for suspension of an impact member, such as a speed bag 72, through a universal connector 74 as is commonly known, such as a speed-bag hanger, an eye bolt and chain, and the like. The mounting plate 70 is a platen-like body comprised of a material such as wood, plastic, metal, fiber glass, and the like, having suitable strength and rigidity for the purposes described herein.

The height of the speed bag 72 can be adjusted by raising the upright member 32 relative to the insert portion 44 and using a fastener 62, such as a bolt or quick-release pin, to fix the upright member 32 at a selected height. The spacing of the lower exercise assembly 16 relative to the speed bag 72 can also be adjusted by adjusting the position of the brace 42 relative to the upright member 38 to rotate the support post 80 above the clevis 56, as indicated by arrow A of FIG. 3, using a fastener 48, such as a bolt or quick-release pin, to fix the brace 42 at a preselected position. The exercise apparatus 10 can also be disassembled and folded for storage by removing the upper frame 30 from the lower frame 36, disattaching the brace 42 from the upright member 38 and pivoting the brace 42 relative to the support post 80, and pivoting the base member 40 to an upright position adjacent the upright member 38, as indicated by arrow B of FIG. 3.

Figure 1:
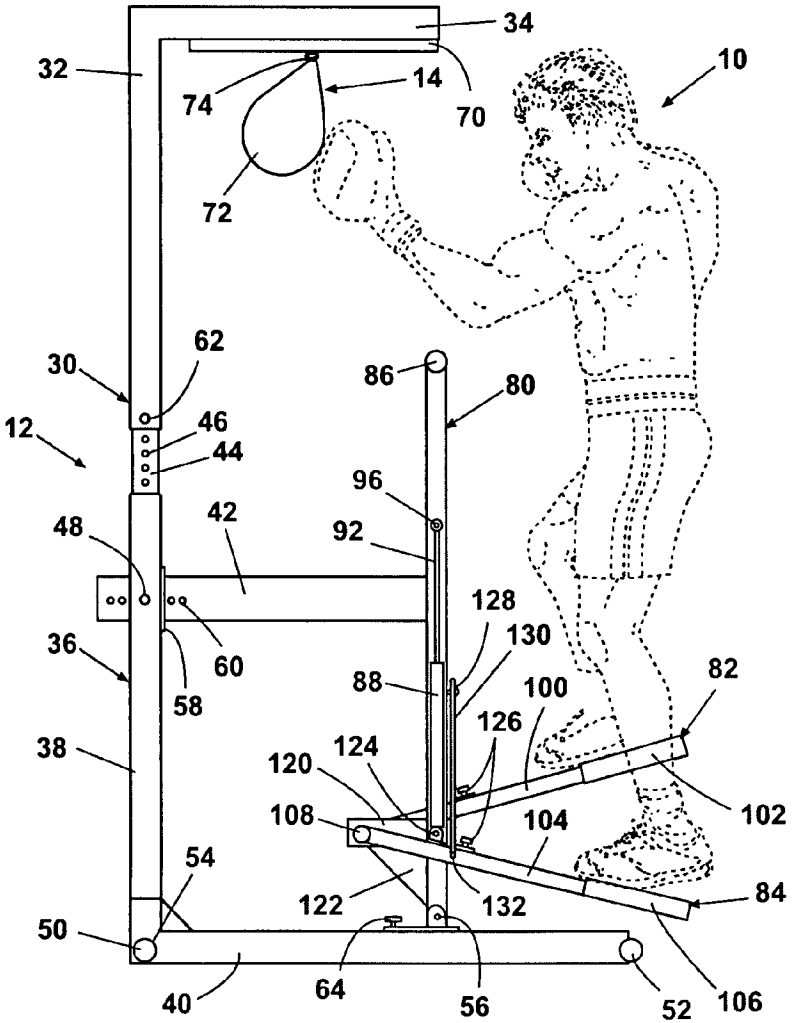
FIG. 1 is a first side elevational view of a first embodiment of an exercise apparatus according to the invention in use by a person shown in phantom for clarity.
Figure 4:
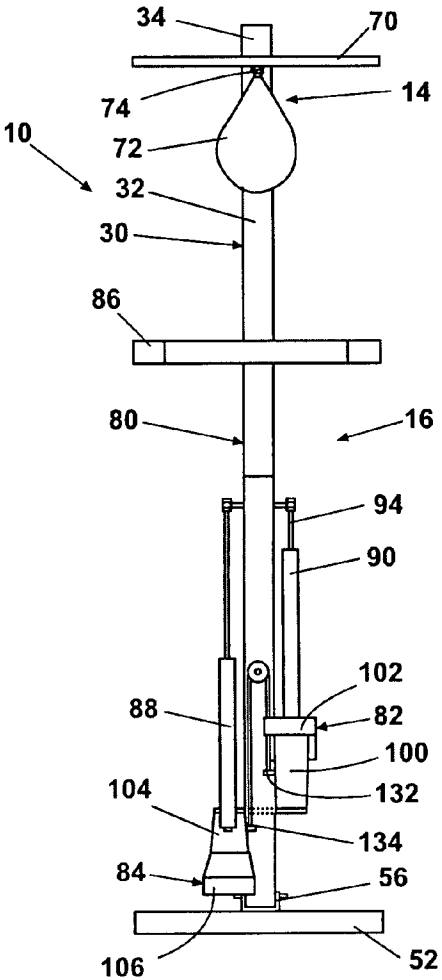
FIG. 4 is a second rear elevational view of the exercise apparatus illustrated in FIG. 2.
Figure 3:
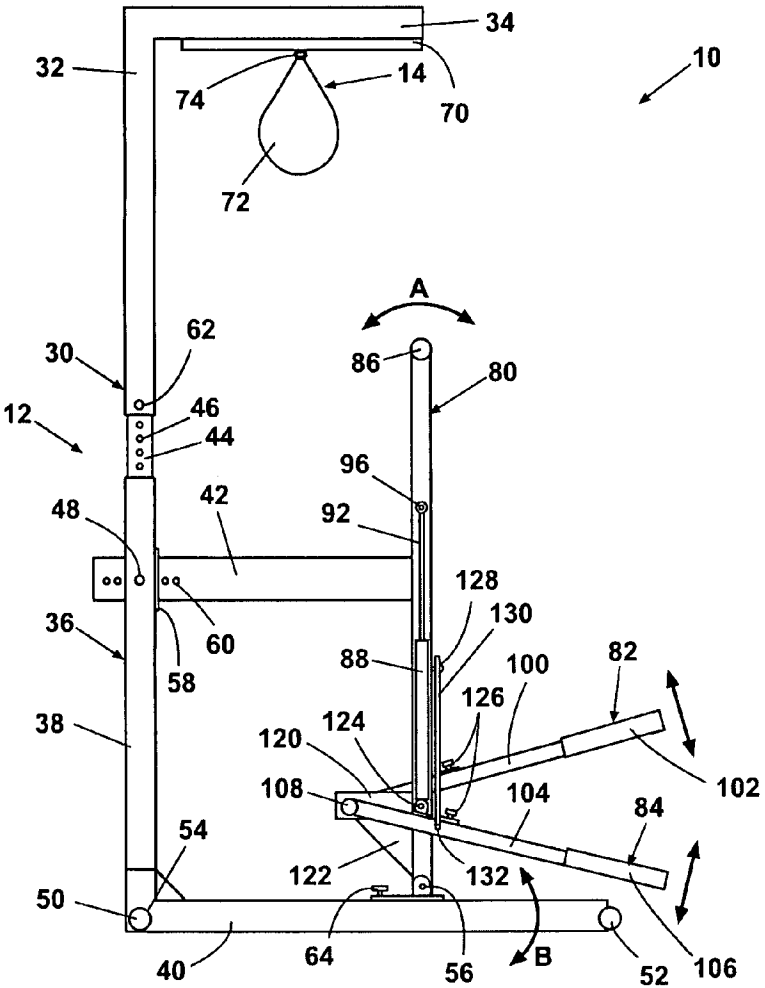
FIG. 3 is a second side elevational view of the exercise apparatus illustrated in FIG. 1.

As illustrated in FIGS. 1 and 2, a user can perform a stepping exercise with the step assemblies 82, 84 to provide a cardiovascular workout while exercise the upper body by striking the speed bag 72. Alternatively, the stepping exercise can be performed while the user grips the hand rest 86. The stepping action will alternately pivot the left and right step assemblies 82, 84 about the pivot connection 108 while the cable 130 runs along the pulley 128 to provide movable support to the step assemblies 82, 84 and the user. The resistance cylinders 88, 90 provide adjustable resistance to the stepping action to control the cardiovascular effect of the exercise. The resistance delivered by the resistance cylinders 88, 90 can be adjusted by loosening the lock screw 184 and translating the clevis plate assembly 126 along the slot 166 to a desired location, and tightening the lock screw 184 to lock the clevis plate assembly 126 in position. Generally, resistance will be increased as the clevis plate assembly 126 is translated toward the pedal 102, 106.

The exercise apparatus 10 provides a full body workout and also works the body bilaterally, thereby improving core strength, balance, and coordination. In addition to a cardiovascular workout, the apparatus 10 strengthen the arms, shoulders, chest and back musculature through retraction/flexure and extension of the user's arms during use of the speed bag 72. Muscle endurance and strength are increased, along with strengthening of ligaments and tendons, and improved hand-eye coordination.

Figure 6:
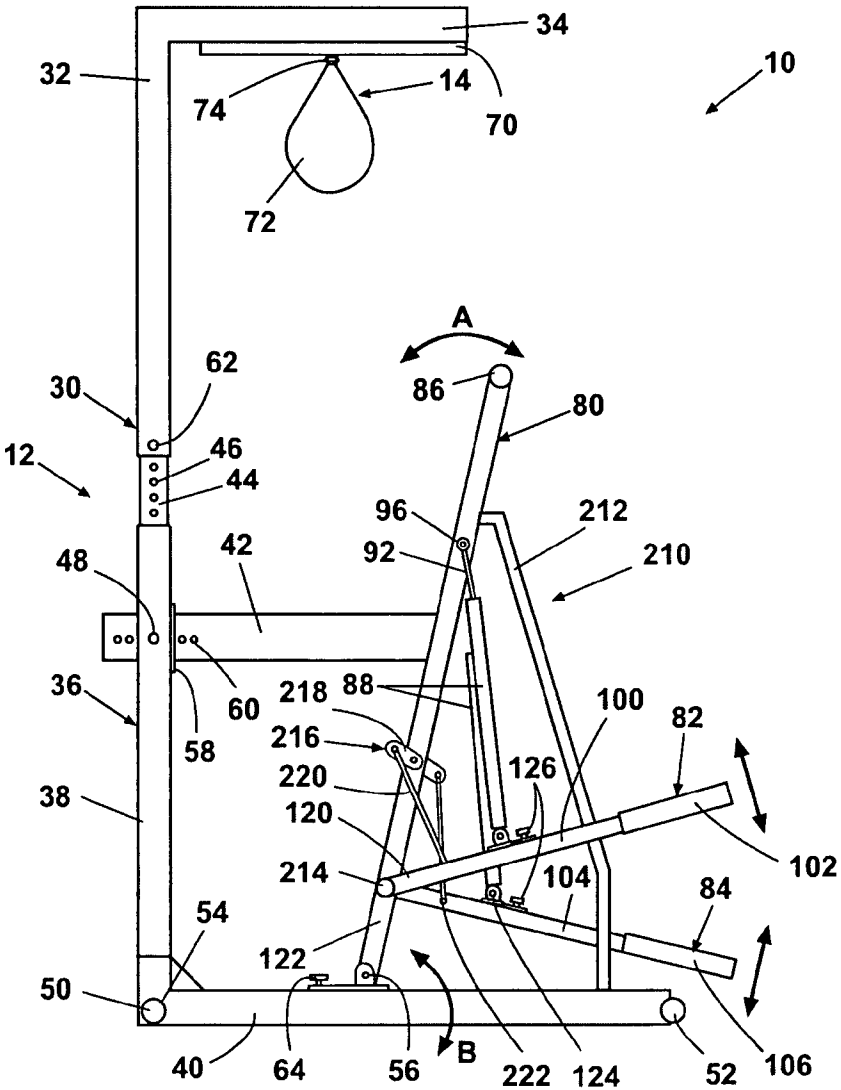
FIG. 6 is a side elevational view of a second embodiment of an exercise apparatus according to the invention.

FIG. 6 illustrates a second embodiment of the invention which comprises many of the elements of the first embodiment described above, which are identified by the same identifiers. In the second embodiment, the lower exercise assembly 210 comprises a base frame 212 connected to the support post 80 and the base member 40 to provide additional strength and rigidity for the support post 80. The step rails 100, 104 are attached directly to the upright member 80 through a pivot connection 214. The pulley and cable are replaced by a pedal support assembly 216 comprising a crank arm 218 rotatably mounted to the support post 80. A pair of linkage members 220 is pivotally attached to the crank arm 218 and the step rails 100, 104 through pivot connections 222. The use of the lower exercise assembly 210 is identical to the use of the lower exercise assembly 16.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An exercise apparatus for exercising a user's body comprising:

an upper exercise assembly for exercising the user's upper body through alternating extension and retraction of the user's arms, the upper exercise assembly comprising an upper upright member coupled with a suspended impact member;

a lower exercise assembly comprising a lower upright member, a base member, a support post, and a substantially horizontally adjustable brace, the lower upright member being separably coupleable with the upper upright member and pivotally coupled with the base member, the base member being adapted for support of the exercise apparatus upon a supporting surface, the support post being pivotally coupled with the base member, and the brace being coupled at a first end with the support post and movably coupled at a second end with the lower upright member; and a pair of step assemblies coupled with the support post for exercising the user's lower body by lifting and extending the user's legs through an alternating stair-climbing motion;

wherein the user can repeatedly strike the impact member while performing the alternating stair-climbing motion to simultaneously exercise the user's upper and lower body; and wherein the lower exercise assembly can be separated from the upper exercise assembly, the brace can be decoupled from the lower upright member, the lower upright member can be folded against the base member, and the support post can be folded against the base member, to facilitate storage of the exercise apparatus.

2. An exercise apparatus according to claim 1 wherein the impact member comprises a speed bag.

3. An exercise apparatus according to claim 1, and further comprising at least one resistance cylinder pivotally coupled with the step assemblies and the support post for providing resistance to pivotal movement of the step assemblies.

4. An exercise apparatus according to claim 3 wherein the at least one resistance cylinder is movably coupled with the step assemblies for adjustment of the resistance to pivotal movement of the step assemblies.

5. An exercise apparatus according to claim 1, and further comprising a pulley coupled with the support post and a cable coupled with the step assemblies for engagement with the pulley to at least partly support the step assemblies.

6. An exercise apparatus according to claim 1, and further comprising a crank arm pivotally coupled with the support post, and a pair of linkage members pivotally coupled with the step assemblies and the crank arm, for at least partial support of the step assemblies and for folding of the step assemblies from a position generally rearward of the support post to a position generally parallel to and adjacent the support post.

7. An exercise apparatus according to claim 1 wherein the upper exercise assembly is slidably coupled with the lower exercise assembly for selective adjustment of the height of the upper exercise assembly above the lower exercise assembly.

8. An exercise apparatus according to claim 1 wherein the support post is pivotably and slidably coupled with the base member so that the support post can be selectively translated and rotated to adjust the location and inclination of the support post relative to the lower upright member.

9. An exercise apparatus according to claim 1, and further comprising an overhead member orthogonally coupled with the upper upright member for swivelably coupling the impact member thereto.

* * * * *